US006662850B2

(12) United States Patent
Chung et al.

(10) Patent No.: US 6,662,850 B2
(45) Date of Patent: Dec. 16, 2003

(54) LIFT COARD CONCEALABLE VENETIAN BLIND LIFT CONTROL MECHANISM

(75) Inventors: Yong-Chen Chung, Kaohsiung Hsien (TW); Chia-Chun Hsu, Keelung (TW); Ming-Chang Dang, Hsinchu (TW)

(73) Assignees: Industrial Technology Research Institute, Hsinchu Hsien (TW); Nien Made Enterprise Co., Ltd., Changhua Hsien (TW)

( * ) Notice: Subject to any disclaimer, the term of this patent is extended or adjusted under 35 U.S.C. 154(b) by 115 days.

(21) Appl. No.: 10/143,958

(22) Filed: May 14, 2002

(65) Prior Publication Data

US 2003/0168189 A1 Sep. 11, 2003

(30) Foreign Application Priority Data

Mar. 7, 2002 (TW) ..... 91202676 U

(51) Int. Cl.[7] ..... E06B 9/30
(52) U.S. Cl. ..... 160/171 R
(58) Field of Search ..... 160/171 R, 170 R, 160/173 R, 84.05, 168.1 R

(56) References Cited

U.S. PATENT DOCUMENTS 2,765,030 A * 10/1956 Bechtler ..... 160/170 R
5,103,888 A * 4/1992 Nakamura ..... 160/171 R
5,318,090 A * 6/1994 Chen ..... 160/171 R
6,012,506 A * 1/2000 Wang et al. ..... 160/170 R
6,024,154 A 2/2000 Wang et al.
6,029,734 A * 2/2000 Wang et al. ..... 160/170 R
6,056,036 A * 5/2000 Todd et al. ..... 160/84.05
6,158,494 A * 12/2000 Huang ..... 160/171 R X
6,283,192 B1 * 9/2001 Toti ..... 160/170 R
6,508,293 B1 * 1/2003 Huang ..... 160/170 R

* cited by examiner

*Primary Examiner*—David Purol
(74) *Attorney, Agent, or Firm*—Browdy and Neimark

(57) ABSTRACT

A lift cord concealable Venetian blind lift control mechanism is constructed to include a base having two hollow screw rods axially aligned at two sides and selectively mounted in the top or bottom rail of a Venetian blind, a revolving rod inserted through the hollow screw rods, a spring member, which provides a torsional force to the revolving rod, two bobbins respectively threaded onto the screw rods for synchronous rotation with the revolving rod. The left and right lift cords of the Venetian blind each have one end connected to the bottom or top rail and the other end fastened to the bobbin such that when the bottom rail of the Venetian blind lifted or lowered by an external force, the bobbins are synchronously rotated to wind up or let off the lift cords; when the external force disappeared, the bobbins are immovable, keeping the bottom rail in position.

6 Claims, 5 Drawing Sheets

LIFT COARD CONCEALABLE VENETIAN BLIND LIFT CONTROL MECHANISM

BACKGROUND OF THE INVENTION

1. Field of the Invention

The present invention relates to Venetian blinds and, more specifically, to a lift cord concealable Venetian blind lift control mechanism for use in a Venetian blind for lifting control that keeps the lift cords from sight and from reach of children.

2. Description of the Related Art

A regular Venetian blind is generally comprised of a top rail, a bottom rail, a plurality of slats arranged in parallel between the top rail and the bottom rail, a lift control mechanism for controlling lifting and positioning of the bottom rail to adjust the extending area of the Venetian blind, and a tilting control mechanism for controlling the tiling angle of the slats to regulate the light. The lift control mechanism comprises a lift cord suspended from the top rail at one side for operation by hand to control the elevation of the bottom rail. Because the lift cord is exposed to the outside, it destroys the sense of beauty of the Venetian blind. Further, because a child can easily reach the exposed lift cord, an accident may occur when a child pulling the lift cord for fun.

U.S. Pat. No. 6,024,154 discloses a Venetian blind lift control mechanism, which keeps the lift cords from sight. It is to be noted that the marked numbers described hereunder are quoted directly from U.S. Pat. No. 6,024,154. According to this design, the Venetian blind lift control mechanism comprises a T-shaped retaining member 51 mounted inside the bottom rail 22 on the middle, two lift cord take-up members 32 respectively pivoted to the T-shaped retaining member 51 at two sides and adapted to wind up the lift cords 41 of the Venetian blind, and two spring means 33 adapted to provide a torsional force to the lift cord take-up members 32 respectively. The T-shaped retaining member 51 has a rack 512, which is forced by springs 513 into engagement with engagement means 322 of the lift cord take-up members 32 to stop the lift cord take-up members 32 from rotary motion, keeping the bottom rail 22 at the desired height. When the user pressed the T-shaped retaining member 51, the lift cord take-up members 32 are released for free rotation. At this time, the user can lift the bottom rail 22 for enabling the torsional force of the spring means 33 to force the lift cord take-up members 32 to wind up the lift cords 41, or pull the bottom rail 22 downward against the torsional force of the spring means 33, so as to adjust the bottom rail 22 to the desired height. This Venetian blind lift control mechanism is complicated, resulting in high manufacturing cost and complicated installation procedure. Further, when adjusting the elevation of the bottom rail, the user has to press the T-shaped retaining member with one hand and move the bottom rail with the other hand.

SUMMARY OF THE INVENTION

The present invention has been accomplished to provide a lift cord concealable Venetian blind lift control mechanism, which eliminates the aforesaid drawbacks. It is the main object of the present invention to provide a lift cord concealable Venetian blind lift control mechanism, which keeps the lift cords of the Venetian blind from sight and out of reach of children. It is another object of the present invention to provide a lift cord concealable Venetian blind lift control mechanism, which is easy to operation. It is still another object of the present invention to provide a lift cord concealable Venetian blind lift control mechanism, which is simple and inexpensive to manufacture. To achieve these objects of the present invention, the lift cord concealable Venetian blind lift control mechanism is installed in a Venetian blind, which comprises a top rail, a bottom rail, a plurality of slats arranged in parallel between the top rail and the bottom rail, and two lift cords vertically inserted through the slats and arranged in parallel. The lift cord concealable Venetian blind lift control mechanism comprises a base installed in one of the top and bottom rails of the Venetian blind, the base comprising two screw rods axially horizontally aligned in a line between the lift cords, an axle hole axially extended through the screw rods; a revolving rod inserted through the axle hole of the base for free rotation relative to the base, the revolving rod having two distal ends respectively extended out of the screw rods; a spring member mounted in the base and adapted to impart a torsional force to the revolving rod; and two bobbins respectively threaded onto the screw rods and coupled to the ends of the revolving rod for synchronous rotation with said revolving rod and for axial movement relative to the screw rods to wind up/let off the lift cords upon forward/backward rotation of the revolving rod.

DETAILED DESCRIPTION OF THE PREFERRED EMBODIMENT

Figure 1:
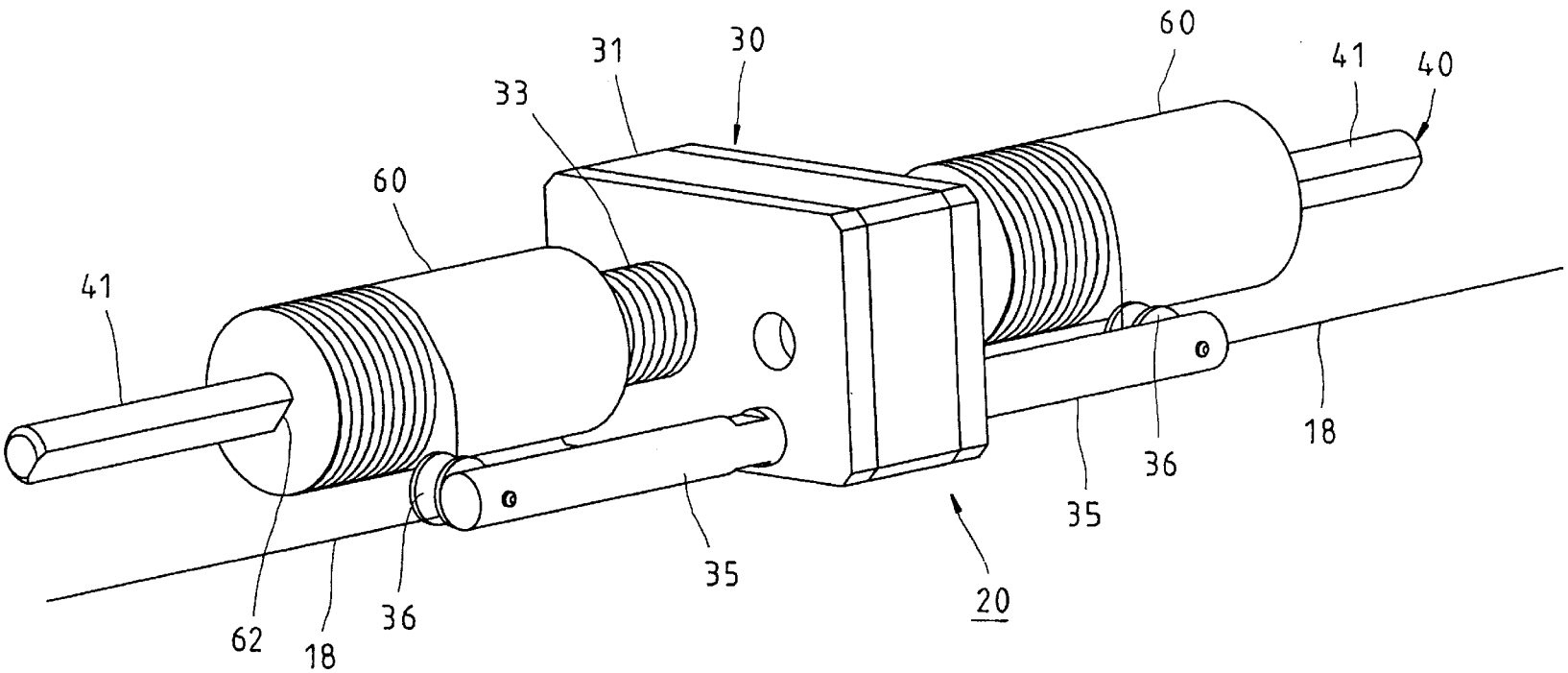
FIG. 1 is an elevational assembly view of a lift cord concealable Venetian blind lift control mechanism according to the preferred embodiment of the present invention.

Referring to FIGS. from 1 through 3, a lift cord concealable Venetian blind lift control mechanism 20 is shown comprised of a base 30, a revolving rod 40, a spring member 50, and two bobbins 60.

The base 30 comprises a casing 31 defining a receiving chamber 32, two screw rods 33 of same diameter and same thread design respectively horizontally extended from the left and right sides of the casing 31 and aligned in a line, an axle hole 34 of circular cross-section axially extended through the screw rods 33 and the casing 31, two arm rods 35 respectively horizontally extended from the left and right sides of the casing 31 in parallel to the screw rods 33 at a lower elevation, and two pulleys 36 respectively provided to the free ends of the arm rods 35. The arm rods 35 have a length approximately equal to the screw rods 33. The pulleys 36 are disposed in such a direction that the central axis of the pulleys 36 extends perpendicular to the central axis of the arm rods 35.

The revolving rod 40 is a round rod inserted through the axle hole 34 of the base 30 for free rotation in the axle hole 34, having two plug portions 41 of non-circular cross-section respectively axially disposed at the ends.

Figure 2:
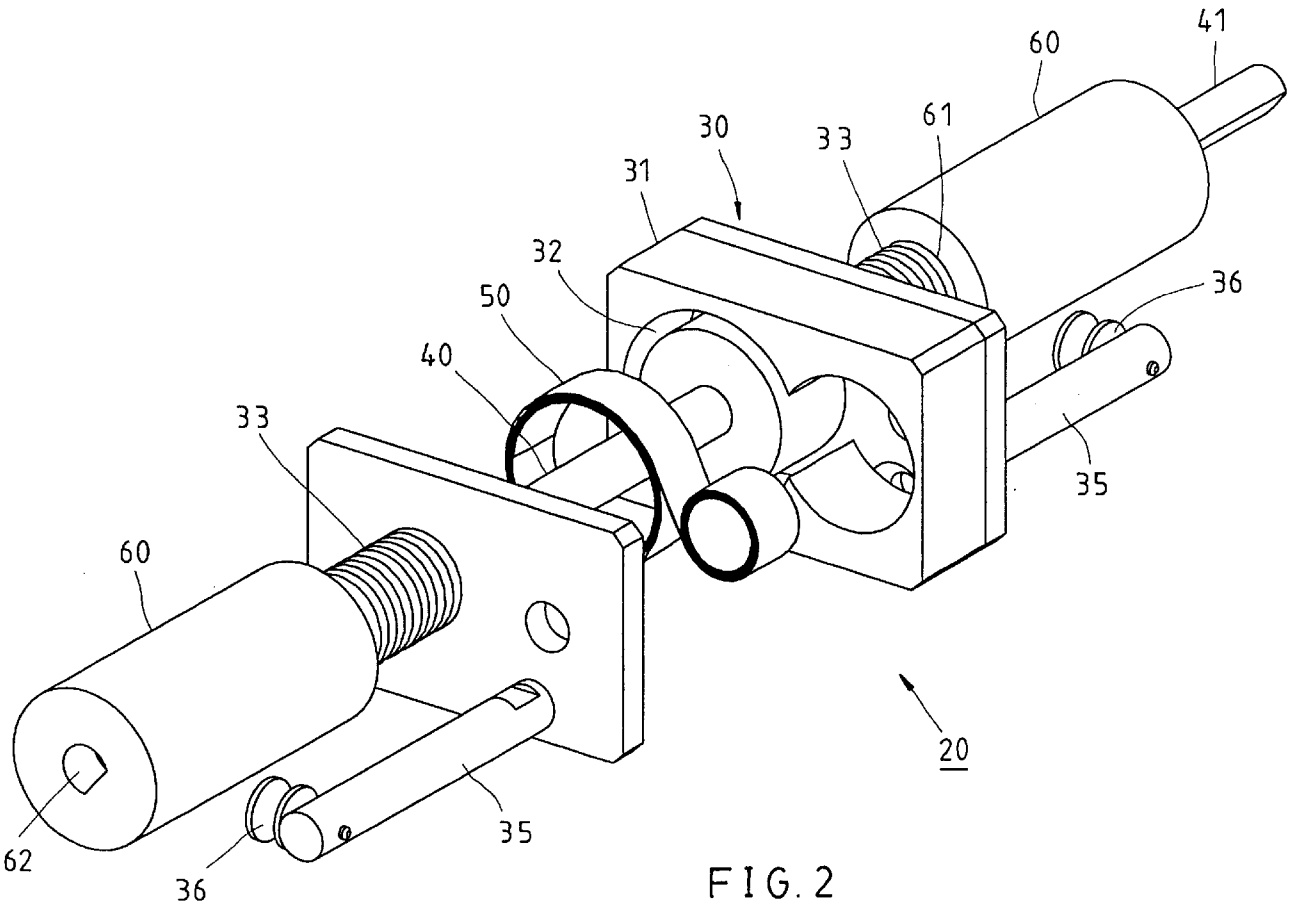
FIG. 2 is an exploded view of the lift cord concealable Venetian blind lift control mechanism according to the preferred embodiment of the present invention.

The spring member 50 is, for example, a torsional spring mounted in the receiving chamber 32 of the base 30, having one end fixedly fastened to the base 30 and the other end fixedly fastened to the revolving rod 40 for imparting a torsional force to the revolving rod 40 in one direction (at the view angle shown in FIGS. 1 and 2, the spring member 50 imparts a torsional force to the revolving rod 40 in counter-clockwise direction).

The bobbins 60 are cylindrical members, each comprising a threaded receiving hole 61 axially extended to one end and respectively threaded onto the screw rods 33 respectively, and a plug hole 62 of non-circular cross-section axially extended to the other end in communication with the threaded receiving hole 61 and respectively forced into engagement with the plug portions 41 of the revolving rod 40. After installation of the bobbins 60 in the revolving rod 40, the bobbins 60 can be synchronously rotated with the revolving rod 40. Because the bobbins 60 are respectively threaded onto the screw rods 33, the bobbins 60 can be rotated forwards/backwards relative to the screw rods 33. According to the present preferred embodiment, the threads of the screw rods 33 have same pitch, and are extended in same direction. Therefore, the bobbins 60 can be moved in same direction as same speed.

Figure 3:
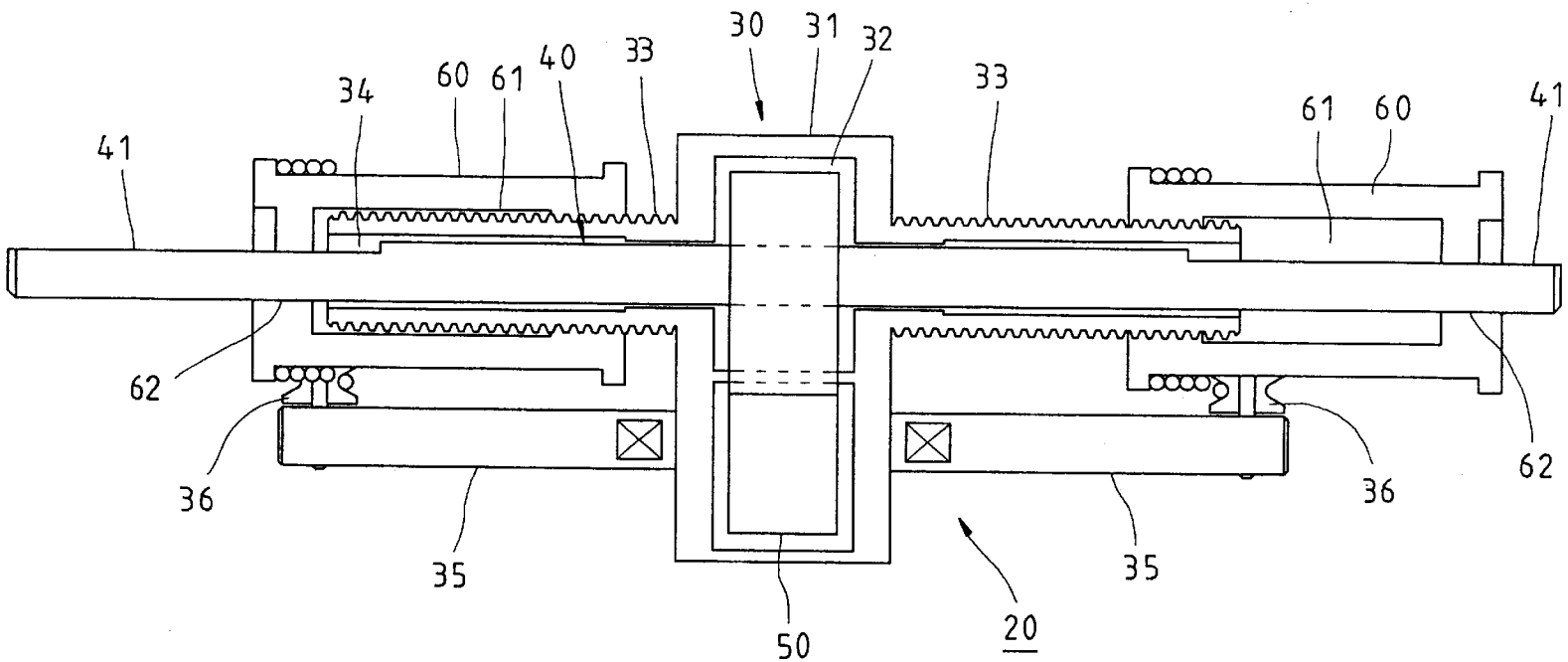
FIG. 3 is a sectional view taken along line 3—3 of FIG. 1.
Figure 4:
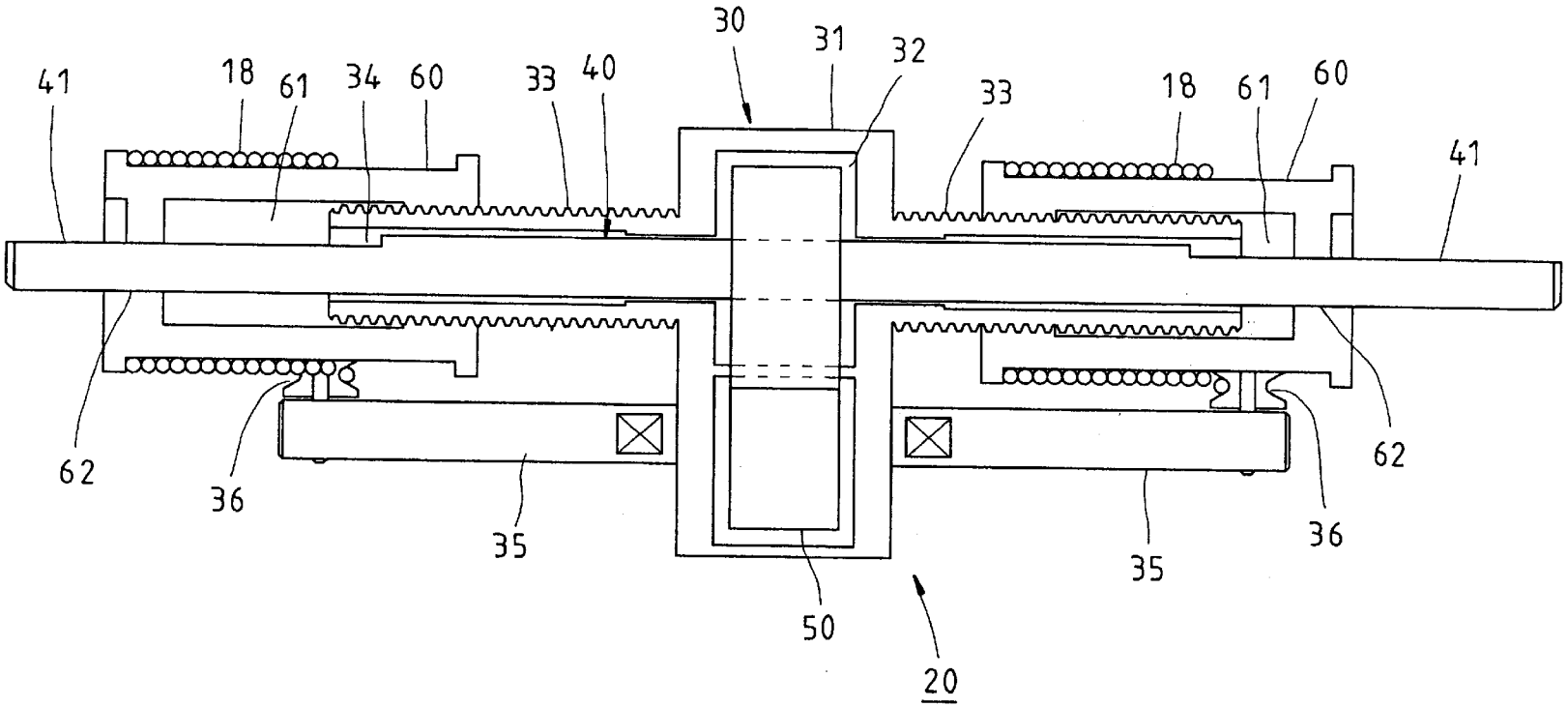
FIG. 4 is similar to FIG. 3 but showing the bobbins respectively moved from the right side position to the left side position.

According to the aforesaid arrangement of the screw rods 33 and the bobbins 60, the left bobbin 60 moves gradually outwards (leftwards) relative to the corresponding screw rod 33 when rotated in counter-clockwise direction, and at the same time the right bobbin 60 moves inwards (leftwards) relative to the corresponding screw rod 33, i.e. the bobbins 60 are respectively moved from the positions shown in FIG. 3 to the positions shown in FIG. 4 during counter-clockwise rotation. On the contrary, the left bobbin 60 moves gradually inwards (rightwards) relative to the corresponding screw rod 33 when rotated in clockwise direction, and at the same time the right bobbin 60 moves outwards (rightwards) relative to the corresponding screw rod 33, i.e. the bobbins 60 are respectively moved from the positions shown in FIG. 4 to the positions shown in FIG. 3 during clockwise rotation.

Figure 5:
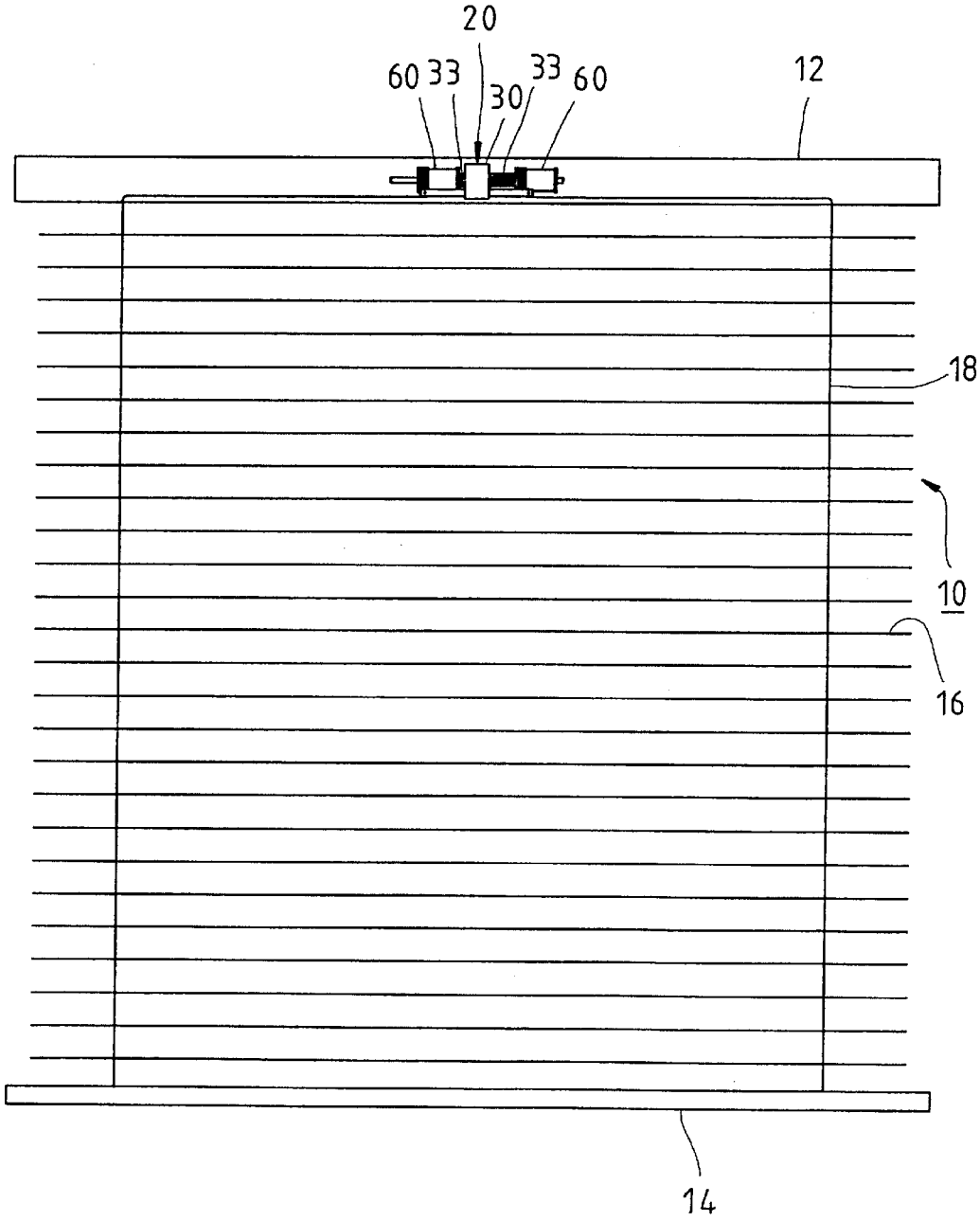
FIG. 5 is an applied view of the present invention, showing he lift cord concealable Venetian blind lift control mechanism installed in a Venetian blind.

FIG. 5 shows the lift cord concealable Venetian blind lift control mechanism installed in a Venetian blind 10. The Venetian blind 10 comprises a top rail 12 fixedly fastened to the top side of the window, a bottom rail 14 disposed at a lower side in parallel to the top rail 12, a plurality of slats 16 arranged in parallel between the top rail 12 and the bottom rail 14, and two lift cords 18 vertically inserted through the slats 16 near the left and right sides (the slat tilting control arrangement of the Venetian blind is of the known art and not within the scope of the claims of the present invention, no further detailed description is needed in this regard).

The lift control mechanism 20 is installed in the middle of the top rail 12, i.e., the base 30 is fixedly fastened to the inside of the top rail 12 on the middle, keeping the screw rods 33 respectively aimed at the left and right sides of the Venetian blind 10. Further, the lift cords 18 each have a bottom end respectively fixedly fastened to the bottom rail 14, and a top end inserted into the inside of the top rail 12 and turned toward the center of the top tail 12 and then extended over the bottom side of the corresponding pulley 36 and then turned upwards and fixedly fastened to the left end of the periphery of the corresponding bobbin 60 (i.e., the left-sided lift cord 18 is fixedly fastened to the outer end of the left-sided bobbin 60; the right-sided lift cord 18 is fixedly fastened to the inner end of the right-sided bobbin 60), keeping the cord body of each lift cord 18 wound round the periphery of the corresponding bobbin 60.

When the Venetian blind 10 extended out (i.e., the bottom rail 14 is lowered to the bottom side) as shown in FIGS. 3 and 5, the bobbins 60 are respectively disposed at the right side of the respective movable range, and the lift cords 18 each have only a small part respectively wound round the bobbins 60. When moving the bobbins 60 toward the left side (counter-clockwise rotation under the view angle of FIG. 1), the bobbins 60 are rotated to wind up the lift cords 18 (see FIGS. 3 and 4). On the contrary, when moving the bobbins 60 toward the right side (clockwise rotation under the view angle of FIG. 1), the bobbins 60 are rotated to let off the lift cords 18.

As stated above, the spring member 50 imparts a torsional force to the revolving rod 40 in counter-clockwise direction, thereby causing the bobbins 60 to be rotated toward the left side (to wind up the lift cords 18). Because the top ends and bottom ends of the lift cords 18 are respectively fastened to the bobbins 60 and the bottom rail 14, the gravity weight of the slats 16 and the bottom rail 14 impart a torsional force to the bobbins 60 in clockwise direction, thereby causing the bobbins 60 to be rotated toward the right side (to let off the lift cords 18). Because the aforesaid two reversed torsional forces are approximately equal (by means of controlling the spring power of the spring member 50 or the weight of the bottom rail 14, the two reversed torsional forces can easily be balanced) and the bobbins 60 are respectively supported on the screw rods 33, the stretching force of the lift cords 18 biases the axis of the bobbins 60 slightly away from the axis of the screw rods 33, thereby causing a friction resistance to be produced between the bobbins 60 and the screw rods 33 to stop the bobbins 60 from free rotation relative to the screw rods 33, i.e., the current length of the lift cords 18 wound round the bobbins 60 as well as the current vertical distance between the top rail 12 and the bottom rail 14 are maintained unchanged, i.e., the lift cords 18 are capable of lifting the bottom rail 12 to a predetermined height.

If the user holds the bottom rail 14 of the Venetian blind 10 and pulls it downwards, the downward pulling force of the lift cords 18 surpasses the torsional force of the spring member 50 (the difference between the aforesaid two reversed torsional forces surpasses the friction resistance between the bobbins 60 and the screw rods 33), and therefore the bobbins 60 are synchronously rotated rightwards to release the lift cords 18 at same speed, enabling the bottom rail 14 to be lowered and keeping the bottom rail 14 in horizontal when lowered. If the user releases the hand from the bottom rail 14, the two reversed torsional forces are returned to the balanced status immediately, thereby causing the bottom rail 14 to be held at the current height. On the contrary, if the user lifts the bottom rail 14 with the hand, the downward pulling force of the lift cords 18 is reduced, and the torsional force of the spring member 50 immediately rotates the bobbins 60 toward the left side, thereby causing the bobbins 60 to wind up the lift cords 18 and to lift the bottom rail 14 until the user has released the hand from the bottom rail 14.

As indicated above, the present invention provides a lift cord concealable Venetian blind lift control mechanism that stably controls closing, opening, and elevational positioning actions of the Venetian blind, and keeps the lift cords from sight. Because the lift cords are kept from sight, the Venetian blind causes a sense of beauty and, keeps the lift cords from reach of children. The structure of the lift cord concealable Venetian blind lift control mechanism is simple, resulting in low manufacturing cost and convenient installation. When adjusting the extending area (elevation) of the Venetian blind, the user needs only to pull or lift the bottom rail of the Venetian blind with the hand to the desired height.

The lift cord concealable Venetian blind lift control mechanism of the present invention can also be selectively installed in the bottom rail of the Venetian blind. In this case, the top ends of the lift cords are respectively fixedly fastened to the top rail, and the bottom ends of the lift cords are respectively wound round the bobbins.

As another alternate form of the present invention, the screw rods have threads extended in reversed directions, and the bobbins are moved axially in reversed directions when rotated in one direction, i.e., the bobbins are respectively moved toward the base when rotated in one direction, or moved away from the base in reversed directions when rotated in the other direction.

Furthermore, a friction member may be installed in the receiving chamber 32 of the base 30 and disposed in contact with a friction portion of the revolving rod 40 so that a friction force is produced between the revolving rod 40 and the base 30 to stop the revolving rod 40 from rotary motion relative to the base 30 when the bottom rail of the Venetian blind receives no pressure from the user.

What the invention claimed is:

1. A lift cord concealable Venetian blind lift control mechanism installed in a Venetian blind, which comprises a top rail, a bottom rail, a plurality of slats arranged in parallel between said top rail and said bottom rail, and two lift cords vertically inserted through said slats and arranged in parallel, the lift cord concealable Venetian blind lift control mechanism comprising:

a base installed in one of the top and bottom rails of said Venetian blind, said base comprising two screw rods axially horizontally aligned in a line between said lift cords, an axle hole axially extended through said screw rods;

a revolving rod inserted through said axle hole of said base for free rotation relative to said base, said revolving rod having two distal ends respectively extended out of said screw rods;

a spring member mounted in said base and adapted to impart a torsional force to said revolving rod; and two bobbins respectively threaded onto said screw rods and coupled to the ends of said revolving rod for synchronous rotation with said revolving rod and for axial movement relative to said screw rods to wind up/let off said lift cords upon forward/backward rotation of said revolving rod.

2. The lift cord concealable Venetian blind lift control mechanism as claimed in claim 1, wherein said bobbins each have a plug hole of non-circular cross-section axially disposed at an outer side; said revolving rod is a round rod, having the two distal ends respectively terminating in a respective plug portion of non-circular cross-section respectively engaged into the plug holes of said bobbins.

3. The lift cord concealable Venetian blind lift control mechanism as claimed in claim 1, wherein said screw rods have a respective thread extended in same direction for enabling said bobbins to be moved axially in same direction when synchronously rotated with said revolving rod.

4. The lift cord concealable Venetian blind lift control mechanism as claimed in claim 1, wherein said base further comprises two arm rods axially aligned at two sides and disposed in parallel to said revolving rod, and two pulleys respectively pivoted to an outer end of each of said arm rods.

5. The lift cord concealable Venetian blind lift control mechanism as claimed in claim 1, wherein said base comprises a receiving chamber; said axle hole extends across said receiving hole; said spring member is a torsional spring mounted in said receiving chamber, having one end fixedly fastened to said base and an opposite end fixedly fastened to said revolving rod.

6. The lift cord concealable Venetian blind control mechanism as claimed in claim 5, wherein said base further comprises a friction member fixedly provided inside said receiving chamber, and said revolving rod has a peripheral friction portion disposed in contact with said friction member.

* * * * *